US007997877B2

(12) United States Patent
Beagle et al.

(10) Patent No.: US 7,997,877 B2
(45) Date of Patent: Aug. 16, 2011

(54) SCROLL COMPRESSOR HAVING STANDARDIZED POWER STRIP

(75) Inventors: Wayne P. Beagle, Chittenango, NY (US); Ronald J. Duppert, Fayetteville, NY (US); Scott R. Almstead, Kirkville, NY (US)

(73) Assignee: Bitzer Kuhlmaschinenbau GmbH (DE)

( * ) Notice: Subject to any disclaimer, the term of this patent is extended or adjusted under 35 U.S.C. 154(b) by 689 days.

(21) Appl. No.: 12/015,660

(22) Filed: Jan. 17, 2008

(65) Prior Publication Data

US 2009/0185921 A1 Jul. 23, 2009

(51) Int. Cl.
*F04B 49/06* (2006.01)

(52) U.S. Cl. ..... 417/44.11; 417/410.5; 361/22

(58) Field of Classification Search ..... 417/410.5, 417/44.11, 572; 361/22, 23, 117, 119, 600
See application file for complete search history.

(56) References Cited

U.S. PATENT DOCUMENTS

| | | | | |
|---|---|---|---|---|
| 3,877,837 | A * | 4/1975 | Parker et al. | 417/25 |
| 4,462,758 | A * | 7/1984 | Speed | 417/38 |
| 4,655,696 | A | 4/1987 | Utter | |
| 4,696,630 | A | 9/1987 | Sakata et al. | |
| 4,927,339 | A | 5/1990 | Riffe et al. | |
| 5,090,878 | A | 2/1992 | Haller | |
| 5,320,506 | A | 6/1994 | Fogt | |
| 5,427,511 | A | 6/1995 | Caillat et al. | |
| 5,582,312 | A | 12/1996 | Niles et al. | |
| 5,588,871 | A | 12/1996 | Salvaneschi | |
| 5,624,237 | A * | 4/1997 | Prescott et al. | 417/33 |
| 5,975,854 | A * | 11/1999 | Culp et al. | 417/18 |
| 6,227,830 | B1 | 5/2001 | Fields et al. | |
| 6,375,439 | B1 * | 4/2002 | Missio | 417/410.1 |
| 6,398,530 | B1 | 6/2002 | Hasemann | |
| 6,439,867 | B1 | 8/2002 | Clendenin | |
| 6,488,489 | B2 | 12/2002 | Williams et al. | |
| 6,615,594 | B2 * | 9/2003 | Jayanth et al. | 62/126 |
| 6,682,327 | B2 | 1/2004 | Milliff et al. | |
| 6,760,216 | B2 * | 7/2004 | Seo | 361/601 |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,112,046 | B2 | 9/2006 | Kammhoff et al. | |
| 2003/0139084 | A1 | 7/2003 | Kim | |
| 2005/0196285 | A1 * | 9/2005 | Jayanth | 417/44.11 |

FOREIGN PATENT DOCUMENTS

EP 0 793 068 A1 9/1997

(Continued)

OTHER PUBLICATIONS

U.S. Appl. No. 12/015,571, filed Jan. 17, 2008, Duppert et al.

(Continued)

*Primary Examiner* — Devon C Kramer
*Assistant Examiner* — Peter J Bertheaud
(74) *Attorney, Agent, or Firm* — Reinhart Boerner Van Deuren P.C.

(57) ABSTRACT

A scroll compressor for compressing fluid has a common terminal block for electrical hook-ups. The compressor includes a compressor section; a drive unit operative to drive the compressor section for compressing fluid; a protection module; and a power connector for connecting electrical power to the drive unit to facilitate operation of the scroll compressor bodies. The common terminal block provides for connection to the protection module and the power connector for the compressor.

16 Claims, 3 Drawing Sheets

FOREIGN PATENT DOCUMENTS

| | | | |
|---|---|---|---|
| EP | 1 138 949 | A2 | 10/2001 |
| GB | 2 104 732 | A | 3/1983 |
| WO | WO 2005/065355 | A2 | 7/2005 |

OTHER PUBLICATIONS

U.S. Appl. No. 12/015,557, filed Jan. 17, 2008, Bush.
U.S. Appl. No. 12/015,689, filed Jan. 17, 2008, Beagle et al.
U.S. Appl. No. 12/015,589, filed Jan. 17, 2008, Bush et al.
U.S. Appl. No. 12/015,592, filed Jan. 17, 2008, Bush et al.
U.S. Appl. No. 12/015,596, filed Jan. 17, 2008, Beagle et al.
U.S. Appl. No. 12/015,599, filed Jan. 17, 2008, Bush.
U.S. Appl. No. 12/015,643, filed Jan. 17, 2008, Duppert et al.
U.S. Appl. No. 12/015,651, filed Jan. 17, 2008, Duppert et al.

* cited by examiner

SCROLL COMPRESSOR HAVING STANDARDIZED POWER STRIP

FIELD OF THE INVENTION

The present invention generally relates to scroll compressors for compressing refrigerant and more particularly relates to electrical control boxes, electrical couplings, powering sources and protection modules for such scroll compressors and/or other such suitable compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

Scroll compressors conventionally include a protection module and a power connector which are typically contained within the control box mounted to the outside of the scroll compressor housing. An electrician will typically couple control leads to the protection module and will also separately couple electrical power leads to a power connector. While this typically works well, electrician error can lead to improper electrical coupling of various leads to the scroll compressor electrical devices. If the leads are incorrectly installed, it can cause damage to the scroll compressor. For example, if the scroll compressor is hooked up incorrectly and caused to run in reverse, a vacuum condition is created between the scroll compressor bodies which can cause the scroll compressor bodies to be urged toward one another.

The present invention is directed toward reducing the propensity for error in the installation and electrical coupling of such scroll compressors.

BRIEF SUMMARY OF THE INVENTION

In one aspect, the invention provides a compressor for compressing fluid having a terminal block for electrical hookups. The compressor includes a compressor section; a drive unit operative to drive the compressor section for compressing fluid; a protection module; and a power connector for connecting electrical power to the drive unit to facilitate operation of the scroll compressor bodies. The terminal block provides for connection to at least one of the protection module and the power connector. At least one power lead connects the terminal block and the power connector.

Another aspect is directed toward a method of electrically configuring a compressor with a terminal block for user interface. The method includes mounting a compressor section and a drive unit in a housing with the drive unit operable to drive the compressor section to facilitate compression of fluid; connecting a power connector to the drive unit; and electrically connecting a protection module to the drive unit. Further, the method includes electrically connecting a terminal block to at least one of the protection module and the power connector.

A further aspect or advantage can be realized when different electrical configurations are provided across different compressors either due to a design change, redesign, different model or other desired reason. As such the method may also include arranging or configuring at least one of the power module and the power connector differently across at least two different compressors; and maintaining a common lead configuration for the terminal block among said at least two different compressors, whereby any changes are transparent to an end user.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
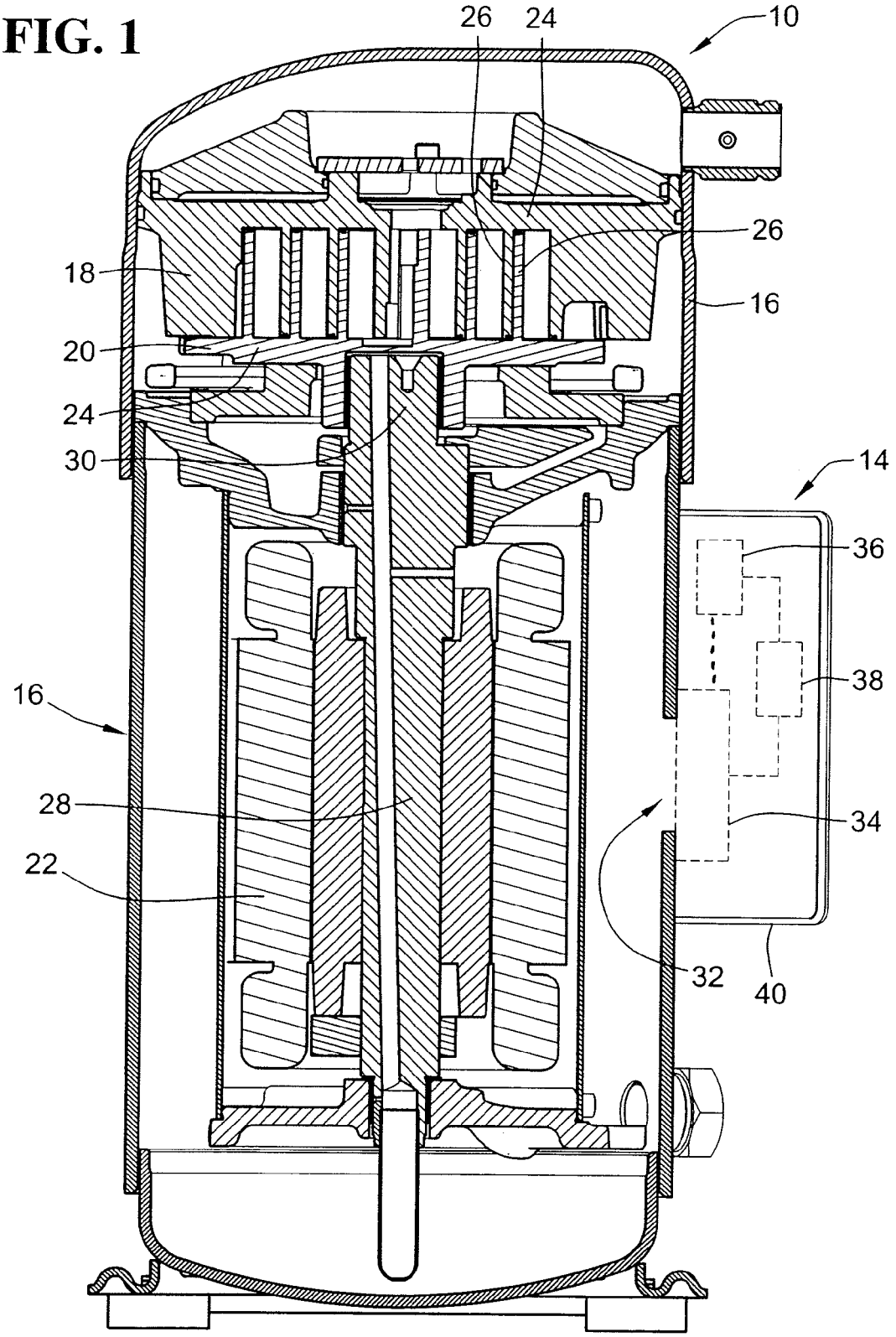
FIG. 1 is a partly schematic cross section of a scroll compressor assembly, with electrical components within the electrical control box shown schematically and coupled schematically in accordance with an embodiment of the present invention.

Referring to FIG. 1, an embodiment of the invention has been shown as a scroll compressor assembly 10 in which a common terminal block 38 is illustrated schematically within a control box 14.

Before turning to the details of electrical configuration accomplished with the common terminal block 38, some background about the illustrated scroll compressor assembly will be provided for reference, although it is understood that this invention is applicable to other compressor configurations. The illustrated scroll compressor assembly 10 generally includes an outer housing 16 (which may be made of several sheet metal shell sections) containing scroll compressor bodies to include a fixed scroll compressor body 18 and a moveable scroll compressor body 20. A drive unit in the form of a electrical motor 22 is provided for driving the moveable scroll compressor body 20 relative to the fixed scroll compressor body 18 to facilitate compression of fluid. To this end, the scroll compressor bodies have respective bases 24 and scroll ribs 26 that project from their respective bases and which mutually engage about an axis for creating chambers for compressing fluid. The electrical motor 22 is operative to provide rotational output on a drive shaft 28, which includes an offset eccentric drive 30 that provides an eccentric orbiting movement to the moveable scroll compressor body 20 relative to the fixed scroll compressor body 18. The scroll compressor bodies provide for a compressor section for the compressor, while the electrical motor provides for a drive section of the scroll compressor.

The control box 14 is mounted exteriorly to the housing 16. A hole 32 through the housing allows for electrical leads to go between the electrical motor 22 within the scroll compressor to the electrical control box 14 to facilitate a power supply for powering the scroll compressor.

Within the control box 14 are provided a variety of electrical devices to include a power connector 34 for connecting electrical power to the electrical motor to operate the electrical motor and thereby the scroll compressor section. The power connector also typically provides a seal to prevent refrigerant within the outer housing 16 from leaking out as well as to prevent outside air from leaking in. Also provided is the protection module 36 that can receive control leads (e.g. leads that carry on and off signals or variable control signals) and has the ability to protect the electrical motor 22 and the scroll compressor from shorts, power surges, overheating, or provide other suitable electrical conditioning as may be appropriate. In accordance with the present invention, the terminal block 38 is provided in spaced relation of the power connector 34 and the protection module 36 and is connected to at least one and preferably both of the protection module 36 and the power connector 34 as schematically illustrated in FIG. 1 and shown in greater detail in the embodiment of FIG. 2.

Figure 2:
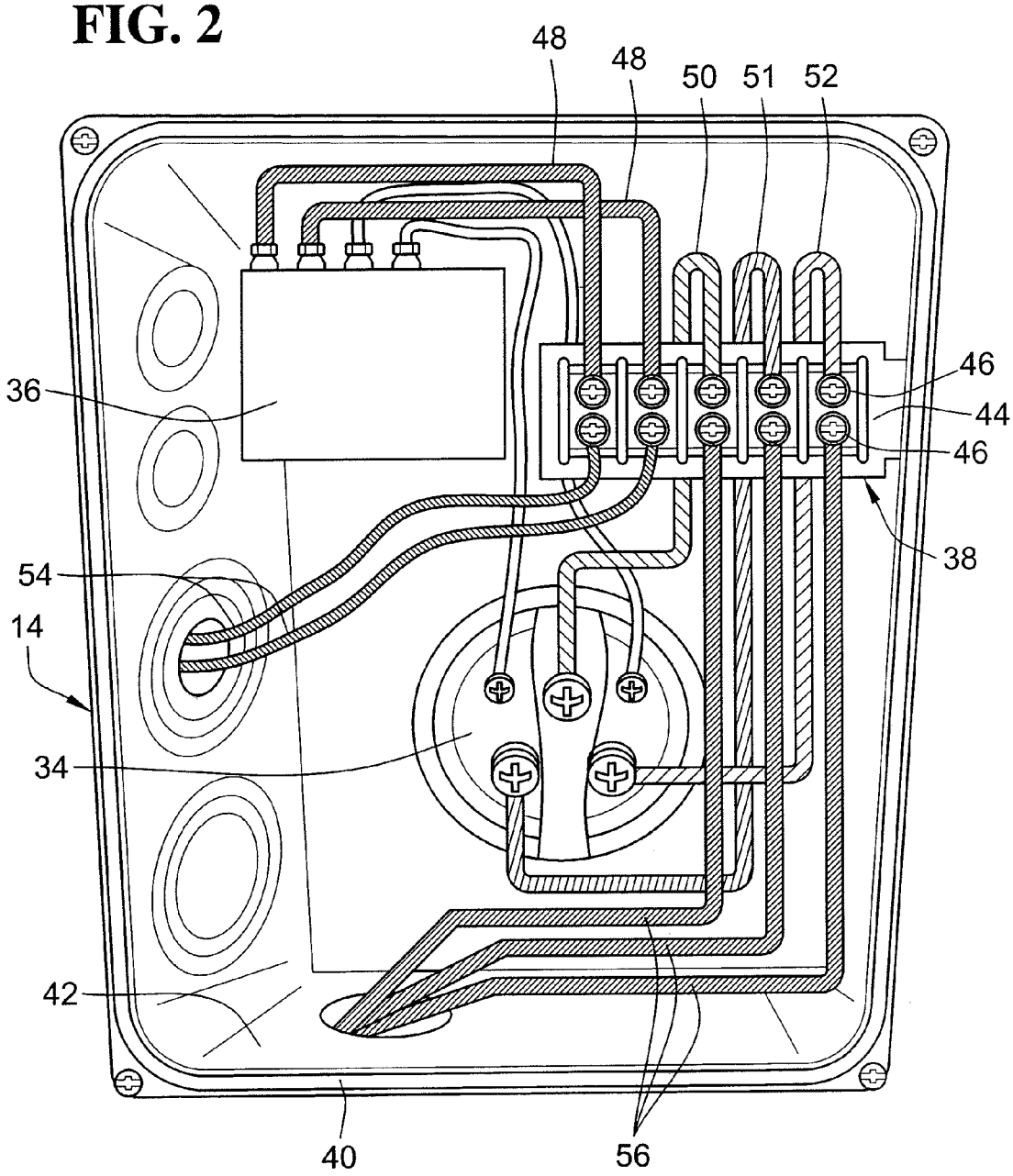
FIG. 2 is a perspective illustration through the opening of the control box of a scroll compressor assembly according to a first configuration and embodiment of the present invention.

Referring to FIG. 2, the terminal block 38 can be mounted to the generally rectangular wall 40 of the control box 14 (e.g. the wall 40 generally projects away from the scroll compressor housing 16). This can be done by gluing, fastening, welding, brazing or the like. Preferably, the terminal block 38 is provided at a location in front of both of the power connector 34 and the protection module 36 toward the open end 42 of the control box 14 defined by the terminating free edge of the control box wall 40.

The terminal block 38 generally includes an insulating body 44 that takes the form of a rectangular strip and a plurality of screw clamps 46 that are arranged in two rows in which adjacent screw clamps 46 (one clamp from each row) are electrically coupled together through a metal contacts strip or otherwise in electrical communication. As shown, the terminal block 38 includes a total of ten screw clamps 46 in which each row includes five screw clamps. The screw clamps provided for electrical couplings for connecting to control leads or power leads.

As illustrated, the terminal block 38 in the first embodiment of FIG. 2 is connected electrically to both the power connector 34 and the protection module 36 through electrical leads. Thus, half of the screw clamps are used and configured at the factory to include connections with two protection module leads 48 connecting the terminal block and the protection module; and three electrical power leads 50-52 connecting the terminal block and the power connector. The protection module leads 48 may be each be a common color such as aqua blue; whereas electrical power leads 50, 51, 52 may each have a different color corresponding to leads to be wired in by an electrician, for example, a white power lead 50, a red power lead 51, and a dark blue power lead 52 which is illustrated by different shading used on different wires shown in the embodiment of FIG. 2.

An electrician can then wire control leads 54 which typically will extend through a punched out hole in the wall 40 of the control box 14 to the terminal block to provide for outside electrical connection to the protection module 36; and the electrician will also separately wire appropriate external power source leads 56 to the terminal block 38 and thereby connect to the electrical power connector 34. The electrician can use the color coding provided by electrical power leads 50, 51 and 52 to appropriately connect the power source leads 56 in corresponding fashion (e.g. each one of the external power source leads 56 may a corresponding color to one of the power leads 50-51).

One significant advantage of utilizing a terminal block 38 within the control box 14 is that different electrical box configurations and/or arrangements of the protection module 36 and/or the power connector 34 within the control box does not affect the electrical installation as any changes can be transparent to the user. Specifically, and referring to a further embodiment of FIG. 3, it is seen that a different arrangement and configuration within the control box 114 is provided with a different arrangement for the power connector 134 and the protection module 136. The same color coding and use of a terminal block 138 in the second configuration and embodiment provides for a common lead configuration among the two different compressor embodiments of FIGS. 2 and 3. In further embodiment of FIG. 3, however, the terminal block 138 provides for only electrical power leads between the power connector 134 and the terminal block 138 with electrical power leads 150, 151 and 152 being accomplished at the factory. This leaves three free screw clamps 146 that can be used by an electrician to attach and install power source leads 156 to the terminal block 138. As with the embodiment of FIG. 2, the control box 114 of FIG. 3 is mounted to the outside of a scroll compressor housing.

Figure 3:
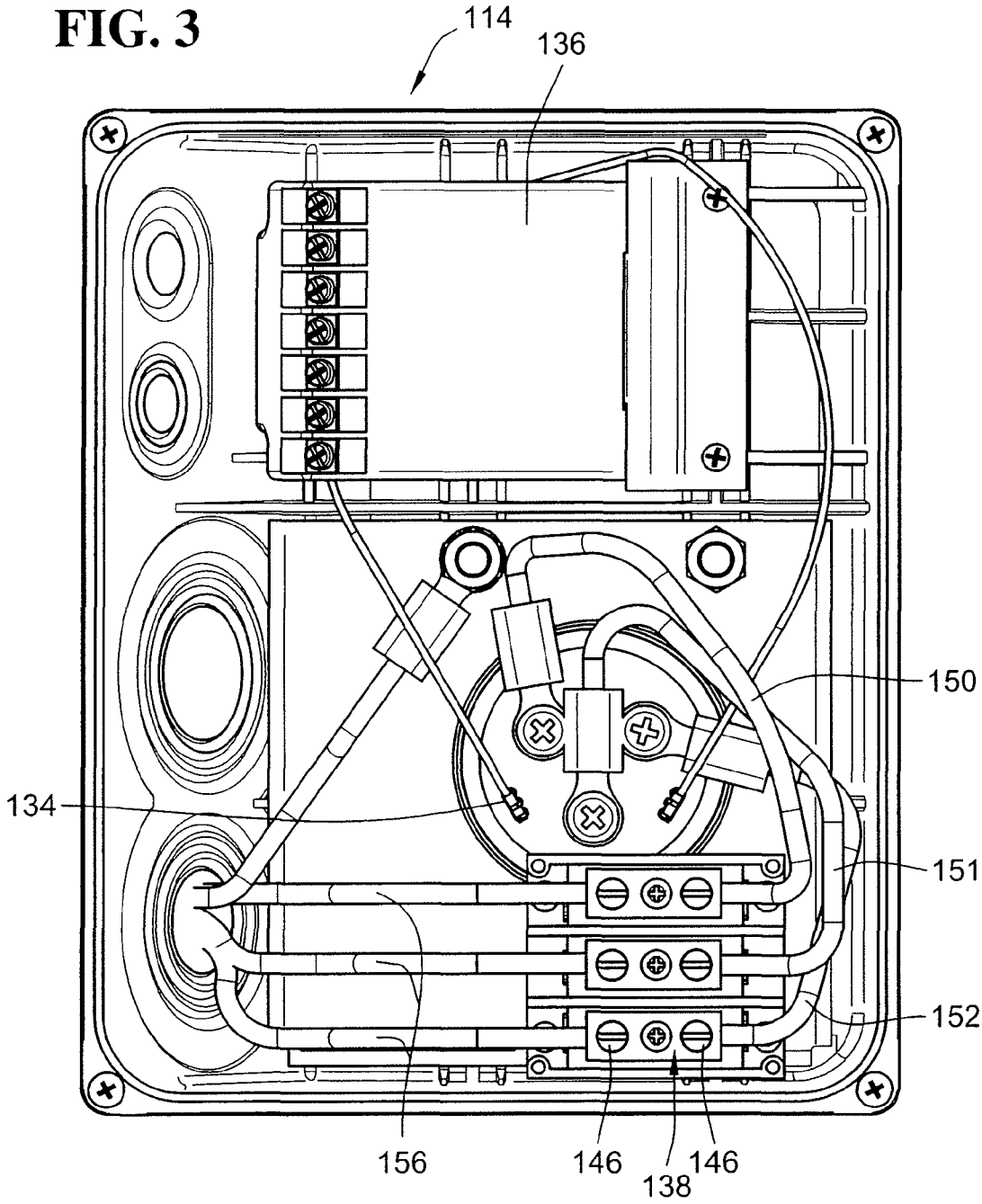
FIG. 3 is another perspective illustration through an opening of a control box of a scroll compressor assembly according to a different configuration and further embodiment of the present invention.

While not shown in FIG. 3, it is also possible to maintain the same arrangement for the terminal block among the two different compressors. For example, the terminal block 138 could be mounted at the same location as the terminal block 38 of the FIG. 2 embodiment.

The transparency achieved by the terminal blocks 38, 138 of different embodiments to an end user such as an electrician will help prevent mistakes among electricians and how they wire and hook up scroll compressors. As a result, difficulties do not arise when changes are made to the scroll compressor and/or to the configuration of devices and/or wires within a control box. By adding an additional component of the terminal block, the electrical hook up and configuration can be simplified.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A compressor for compressing fluid, comprising;

a compressor section;

a drive unit operative to drive the compressor section for compressing fluid;

a protection module configured to protect the compressor from short circuits and power surges;

a power connector for connecting electrical power to the drive unit to facilitate operation of the compressor section;

a terminal block providing separate connections to an external power source, the protection module, and the power connector;

at least one power lead connecting the terminal block and the power connector; and a separate protection module lead connecting the terminal block and the protection module.

2. The compressor of claim 1, wherein the compressor is a scroll compressor, the scroll compressor including a housing containing scroll compressor bodies and the drive unit, the scroll compressor bodies having respective bases and respective scroll ribs that project from the respective bases and which mutually engage about an axis for compressing fluid, the drive unit operative to facilitate relative movement between the scroll compressor bodies.

3. The compressor of claim 2, further comprising a control box carried on the outside of the housing, the control box housing the protection module, the power connector and the terminal block.

4. The compressor of claim 3, wherein the terminal block is mounted to the control box housing.

5. The compressor of claim 4, wherein the terminal block is mounted in front of the protection module and the power connector relative to an open end of the control box.

6. The compressor of claim 5, wherein two protection module leads are connecting the terminal block and the protection module, and wherein three power leads are connecting the terminal block and the power connector.

7. The compressor of claim 6, and wherein the terminal block includes two free electrical couplings for connecting to control leads; and three free electrical couplings for connecting to the electrical power source leads.

8. The compressor of claim 1, wherein the terminal block includes an insulating body and a plurality of screw clamps arranged in two rows.

9. A method of configuring a compressor, comprising:

mounting a compressor section and a drive unit in a housing with the drive unit operable to drive the compressor section to facilitate compression of fluid;

connecting a power connector to the drive unit;

electrically connecting a protection module to the drive unit, the protection module configured to protect the compressor from short circuits and power surges;

electrically connecting a terminal block having of separate connections to an external power source, the protection module, a control signal source, and the power connector;

and configuring the terminal block such that the connections to external power are independent of the configuration of components within the compressor.

10. The method of claim 9, further comprising:

mounting a control box to the housing; and containing the protection module, the terminal block and the power connector in the control box.

11. The method of claim 10, further comprising mounting the terminal block to the control box in front of the power connector and the protection module relative to an opening in the control box.

12. The method of claim 9, wherein the compressor section is a scroll compressor section comprising scroll compressor bodies having respective bases and respective scroll ribs that project from the respective bases and which mutually engage about an axis for compressing fluid, the drive unit operative to facilitate relative movement between the scroll compressor bodies.

13. A compressor for compressing fluid, comprising;

a compressor section having two scroll compressor bodies;

a drive unit configured to drive the two scroll compressor bodies in order to compress fluid;

a power connector through which electrical power and control signals are provided to the drive unit to operate the compressor section;

a protection module configured to protect the compressor from overheating; and a terminal block which provides for separate electrical connections to the power connector, the protection module, an external power source, and a source of the control signals;

wherein the terminal block is configured such that connections for the external power source and the source of the control signals are independent of component configuration in the compressor.

14. The compressor of claim 13, wherein the terminal block includes a plurality of screw terminals to provide for the electrical connections, and wherein a first portion of the plurality of screw terminals are connected to the power connector and protection module prior to installation of the compressor.

15. The compressor of claim 14, wherein a second portion of the plurality of screw terminals are connected to the external power source and source of the control signals during installation of the compressor.

16. The compressor of claim 13, wherein the terminal block, power connector, and protection module are located in a control box on the outside of a housing for the compressor.

* * * * *

UNITED STATES PATENT AND TRADEMARK OFFICE

CERTIFICATE OF CORRECTION

PATENT NO. : 7,997,877 B2
APPLICATION NO. : 12/015660
DATED : August 16, 2011
INVENTOR(S) : Wayne P. Beagle et al.

It is certified that error appears in the above-identified patent and that said Letters Patent is hereby corrected as shown below:

Column 6

Line 37, Claim 9, remove the word "of"

Signed and Sealed this
Eighteenth Day of October, 2011

David J. Kappos

David J. Kappos
*Director of the United States Patent and Trademark Office*